US011453033B2

(12) United States Patent
Stockhowe et al.

(10) Patent No.: US 11,453,033 B2
(45) Date of Patent: Sep. 27, 2022

(54) FLIP-FLOP SCREENING MACHINE

(71) Applicant: HEIN, LEHMANN GMBH, Krefeld (DE)

(72) Inventors: Andree Stockhowe, Krefeld (DE); Manfred Heffe, Korschenbroich (DE)

(73) Assignee: HEIN, LEHMANN GMBH, Krefeld (DE)

( * ) Notice: Subject to any disclaimer, the term of this patent is extended or adjusted under 35 U.S.C. 154(b) by 0 days.

(21) Appl. No.: 17/272,355

(22) PCT Filed: Apr. 30, 2020

(86) PCT No.: PCT/EP2020/062023
§ 371 (c)(1),
(2) Date: Mar. 1, 2021

(87) PCT Pub. No.: WO2020/225091
PCT Pub. Date: Nov. 12, 2020

(65) Prior Publication Data

US 2022/0048074 A1 Feb. 17, 2022

(30) Foreign Application Priority Data

May 6, 2019 (DE) ..... 10 2019 003 163.6

(51) Int. Cl.
*B07B 1/48* (2006.01)
*B07B 1/42* (2006.01)

(52) U.S. Cl.
CPC ..... *B07B 1/485* (2013.01); *B07B 1/42* (2013.01)

(58) Field of Classification Search
CPC ..... B07B 1/485; B07B 1/42
USPC ..... 209/310
See application file for complete search history.

(56) References Cited

U.S. PATENT DOCUMENTS

2016/0256895 A1 9/2016 Birnbaum et al.

FOREIGN PATENT DOCUMENTS

| | | | | | |
|---|---|---|---|---|---|
| CN | 1256187 | C | * | 5/2006 | ..... B07B 1/28 |
| CN | 105636713 | A | * | 6/2016 | ..... B07B 1/485 |
| DE | 765 941 | C | | 5/1954 | |
| DE | 3521753 | A | * | 12/1986 | ..... B07B 1/46 |
| DE | 3521753 | C2 | | 8/1990 | |
| DE | 10 2013 018873 | B3 | | 11/2014 | |
| EP | 0 218 575 | A2 | | 4/1987 | |

(Continued)

*Primary Examiner* — Terrell H Matthews
(74) *Attorney, Agent, or Firm* — Norman B. Thot

(57) ABSTRACT

A flip-flop screening machine includes two screening machine side walls and transverse supports which carry screen panels. The transverse supports are provided as a powered transverse support and as a non-powered transverse support. The transverse supports are arranged between the two screening machine side walls in a transverse direction of a direction in which a screened material is conveyed. At least every second of the transverse supports is provided as the powered transverse support. Each powered transverse support performs oscillations and/or vibrations with movements in a transverse direction of a longitudinal axis of the powered transverse support to alternately compress and stretch the screen panels. Each powered transverse support has over a substantial part of a length or over an entire length thereof a separate oscillatory or vibratory drive which is arranged between the two screening machine side walls.

21 Claims, 3 Drawing Sheets

(56) References Cited

FOREIGN PATENT DOCUMENTS

| | | | | | |
|---|---|---|---|---|---|
| EP | 218575 | A | * | 4/1987 | ..... B07B 1/28 |
| EP | 0218575 | A2 | * | 4/1987 | ..... B07B 1/485 |
| EP | 978327 | A2 | * | 2/2000 | ..... B07B 1/28 |
| EP | 0 978 327 | B1 | | 11/2002 | |
| GB | 499031 | A | | 1/1939 | |

* cited by examiner

FLIP-FLOP SCREENING MACHINE

CROSS REFERENCE TO PRIOR APPLICATIONS

This application is a U.S. National Phase application under 35 U.S.C. § 371 of International Application No. PCT/EP2020/062023, filed on Apr. 30, 2020 and which claims benefit to German Patent Application No. 10 2019 003 163.6, filed on May 6, 2019. The International Application was published in German on Nov. 12, 2020 as WO 2020/225091 A1 under PCT Article 21(2).

FIELD

The present invention relates to a flip-flop screening machine with transverse supports carrying the screen panels, the transverse supports being arranged between screening machine side walls in a transverse direction of the direction in which the screened material is conveyed and at least every second transverse support being a powered transverse support performing oscillations and/or vibrations with movements in a transverse direction of the longitudinal axis of the transverse support in order to alternately compress and stretch the screen panels.

BACKGROUND

Flip-flop screening machines which are, for example, described in DE 35 21 753 C2 and in EP 978 327 B1, can be subdivided into two categories: positively driven flip-flop screening machines and unbalance-driven flip-flop screening machines. In positively driven screening machines, the movement is usually forced positively by an eccentric shaft. The side walls of both screening machine systems thereby perform linear movements in opposite directions along the longitudinal axis.

In unbalance-driven flip-flop screening machines, unbalance shafts cause circular or linear oscillations in the machines. An additionally coupled mass-spring system oscillates at a higher amplitude so that a relative movement is caused between the tensioning shafts which can be used to tension the screen panels.

SUMMARY

An aspect of the present invention is to improve an unbalance-driven flip-flop screening machine of the kind referred to above to combine simple construction and design with low weight and small external dimensions so as to permit a modular design.

In an embodiment, the present invention provides a flip-flop screening machine which includes two screening machine side walls and transverse supports which are configured to carry screen panels. The transverse supports are provided as a powered transverse support and as a non-powered transverse support. The transverse supports are arranged between the two screening machine side walls in a transverse direction of a direction in which a screened material is conveyed. At least every second of the transverse supports is provided as the powered transverse support. Each powered transverse support is configured to perform at least one of oscillations and vibrations with movements in a transverse direction of a longitudinal axis of the powered transverse support so as to alternately compress and stretch the screen panels. Each powered transverse support comprises over a substantial part of a length or over an entire length thereof a separate oscillatory or vibratory drive which is arranged between the two screening machine side walls.

BRIEF DESCRIPTION OF THE DRAWINGS

The present invention is described in greater detail below on the basis of embodiments and of the drawings in which.

DETAILED DESCRIPTION

Figure 1:
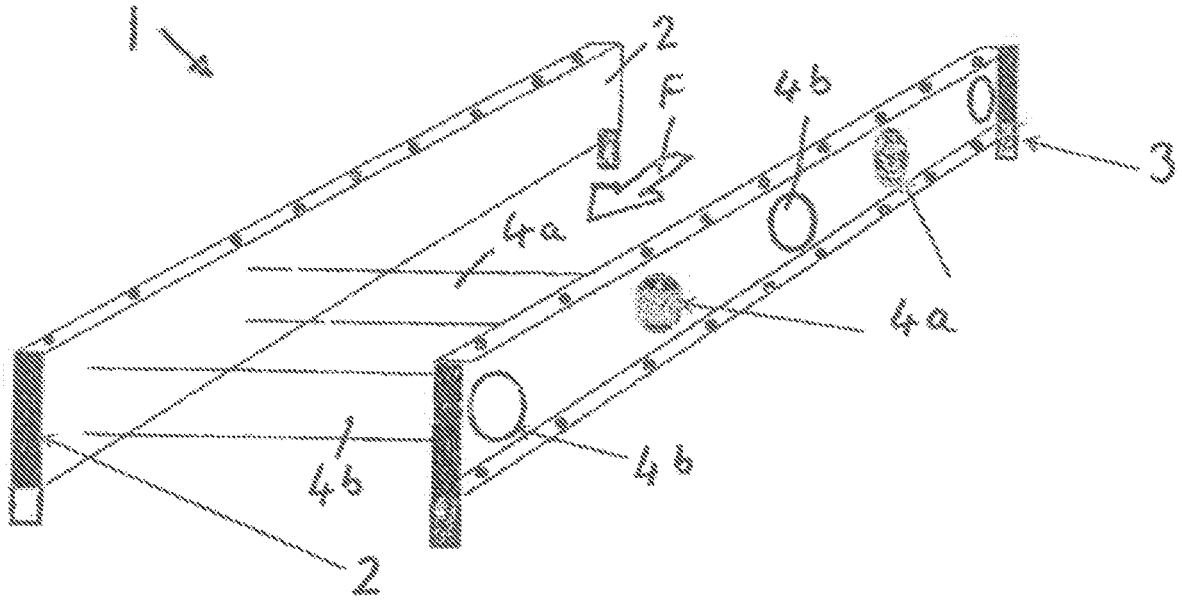
FIG. 1 shows a perspective view of a flip-flop screening machine with two powered and three non-powered transverse supports without showing the screen panels/screen mats.

The present invention provides that each of the powered transverse supports has over a large part of its length or over its entire length its own, separate oscillatory or vibratory drive between the machine side walls.

The transverse supports attached to a side wall are alternately provided as rigid and movable supports. The movable transverse supports are not only used to fasten the screen mats, but to additionally accommodate a vibratory drive. An appropriate drive could, for example, be an unbalance tubular motor. The transverse supports are directly caused to oscillate with this design without any excitation by a large unbalance drive and the moved side walls.

A part of the oscillation is transferred through the resilient coupling to the side walls causing the machine to perform an additional circular/elliptic or linear oscillation.

This design offers a number of benefits:

- Several drives are distributed over the machine length so that the application of force occurs at several points and the height of the side walls and the required sway stiffness can be significantly reduced.
- The lower machine weight results in a lower total driving power and reduced energy consumption.
- The drives are encapsulated so safeguards can be omitted and an accident hazard is effectively and completely eliminated because the design provides that no moving parts are accessible from the outside.
- A lateral motor arrangement is no longer necessary resulting in a reduced width of the building dimensions.
- Independent of the length of the machine, the multiple application of force makes a superelevation of the side walls unnecessary.
- This uniform design and size of the side walls with a lower and constant overall height permits a modular use. Machines can be coupled into bigger machines by adding components.
- A coupling into double-deck or multiple-deck machines is also possible.
- The modular design also permits a subsequent change of the machine size; the flexible adaptation results in a sparing use of resources.

Embodiments of the present invention are illustrated schematically in the drawings and are described in greater detail below.

A flip-flop screening machine 1 has two parallel vertical machine side walls 2, 3 between which transverse supports 4*a*, 4*b* are borne which carry screen panels, in particular screen mats, the, for example, horizontal longitudinal axis of the traverse supports 4*a*, 4*b* being perpendicular to the side walls 2, 3. Every second transverse support 4*a* performs a circular or linear movement, in particular an oscillation, whereas the transverse supports 4*b* arranged therebetween are not powered so that in operation, the distances between the transverse supports 4*a*, 4*b* alternately increase and decrease as a result of which the screen panels, in particular screen mats, between the transverse supports 4*a*, 4*b* and fastened to the transverse supports 4*a*, 4*b* are stretched and compressed so that the screen holes do not clog.

The prior art describes that the powered transverse supports are powered outside of the side walls in that the transverse supports are extended through one side wall and there connected with a drive. The present invention provides that each powered transverse support 4*a* has its own separate drive which is accommodated inside the transverse support 4*a*. All powered transverse supports thus each have over a large part of their length or their entire length an oscillatory or vibratory drive between the machine side walls. Each powered transverse support 4*a* has an outer tube casing 5 which extends in the longitudinal direction of the transverse support 4*a*, the interior space of which tube casing 5 accommodates a drive which generates the oscillations and/or vibrations, in particular an electric (unbalance) motor 6, with a motor shaft 7, an eccentric 8, shaft bearings 9, lateral rubber elements 10 and lateral flange plates 12. The tube casing 5 extends between the two side walls 2, 3 of the flip-flop screening machine 1. The coupling with the side wall 2, 3 is either a rigid element or is established via a flexible rubber coupling.

Each powered transverse support 4*a* therefore has an unbalance tubular motor or vibratory tubular motor inside. The unbalance tubular motor has a motor shaft 7 parallel to the longitudinal axis of the transverse support 4*a* upon which motor shaft 7 an unbalance body in the form of an eccentric 8 is arranged which extends over a large part of the length of the transverse support 4*a*. The geometry of the motor shaft 7 is designed so that the unbalance mass is integrated in the motor shaft 7 and creates an unbalance/centrifugal force during operation.

Figure 2:
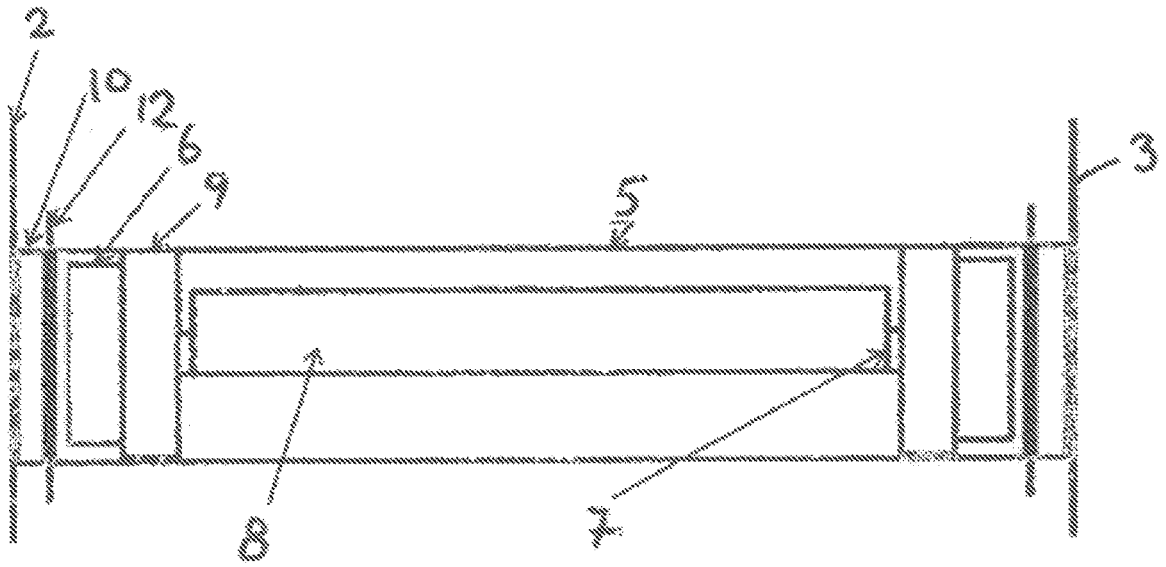
FIG. 2 shows an axial section through an unbalance tubular motor between the machine side walls.
Figure 3:
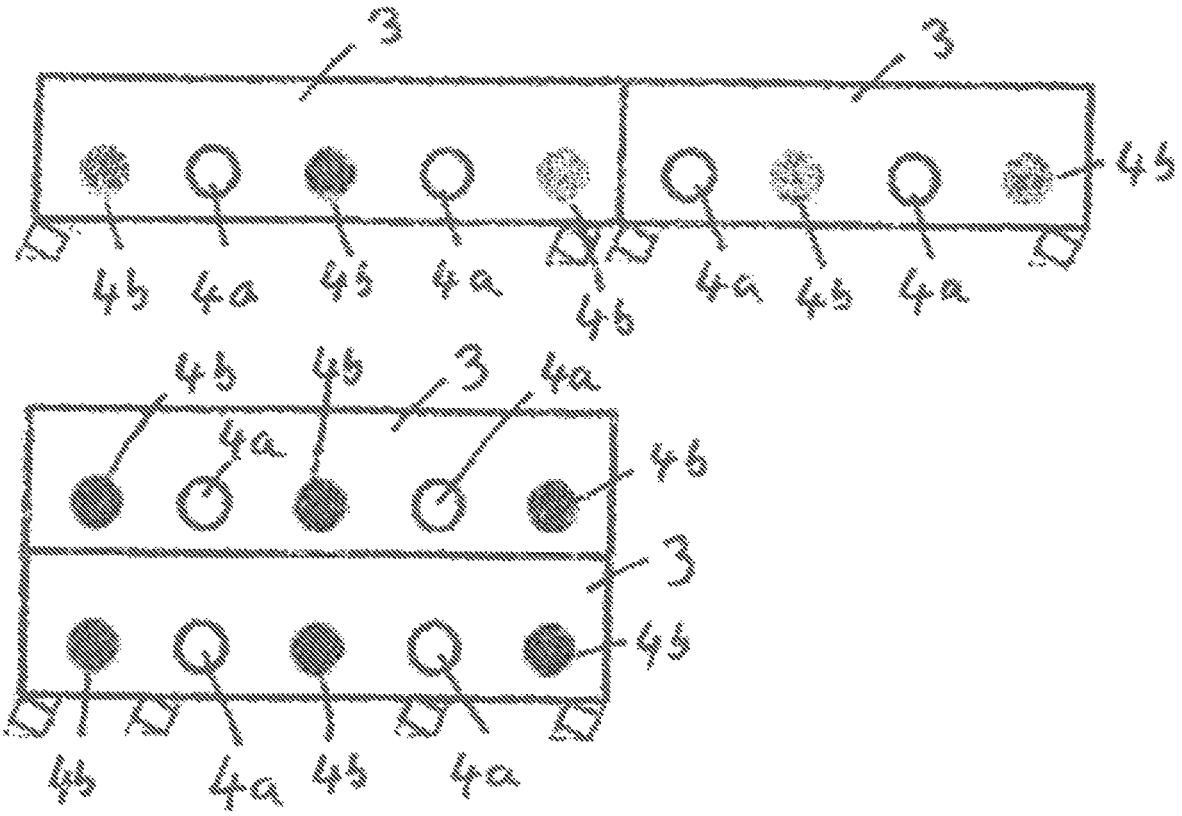
FIG. 3 shows side views of modularly designed flip-flop screening machines with screening machine modules arranged next to or on top of one another.
Figure 4:
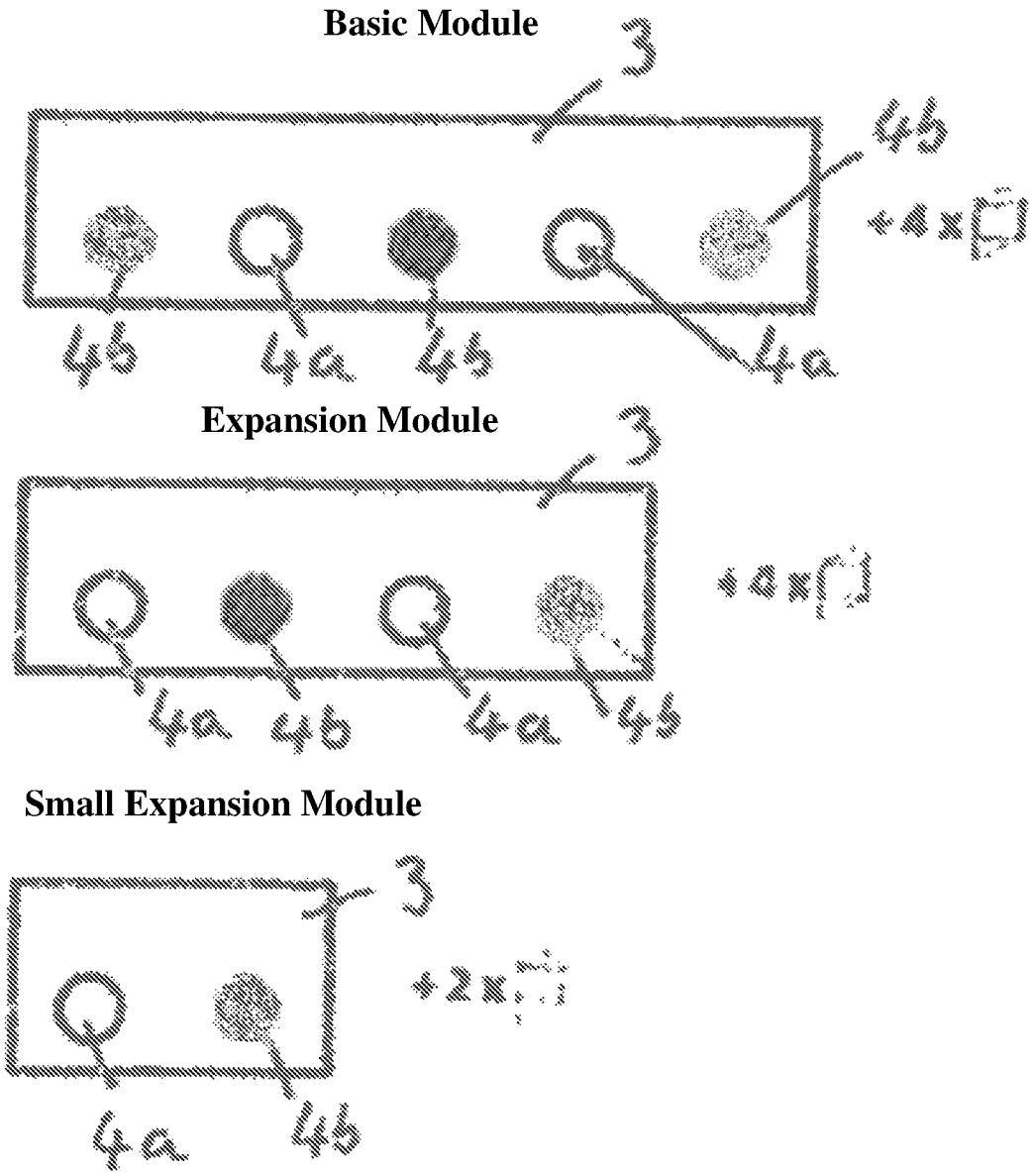
FIG. 4 shows three screening machine modules of different sizes.

In the design shown in FIG. 2, each powered transverse support 4*a* exhibits at each of its two ends an electric motor 6 generating the oscillations or vibrations, and the eccentric 8 (which is sometimes referred to as an unbalance body) is arranged on the single motor shaft 7 between the motors. The unbalance body 8 of a transverse support 4*a* extends over the intermediate space between the two electric motors 6 of the transverse support 4*a*.

In a further embodiment of the present invention, the transverse supports 4*a*, 4*b* are connected with the screening machine side walls 2, 3 by resilient couplings so that additional circular/elliptic and/or linear oscillations are transferred to the screen panels or to the screen panels and the machine side walls 2, 3.

The flip-flop screening machine 1 can, for example, have a modular design, with modules being coupled to double-deck or multiple-deck machines. The modules each have two screening machine side walls 2, 3 between which at least one powered and one non-powered transverse support extend. It is advantageous in this respect that the screening machine side walls 2, 3 have a constant height over their length.

In a further embodiment of the present invention, longitudinal supports with front and rear walls are used instead of the transverse supports and side walls, the longitudinal supports performing oscillations in a transverse direction of the screening and material flow direction. The transverse or longitudinal supports may in out-of-phase operation also perform different movements, in particular movements in opposite directions. It is further an advantage if the transverse and/or longitudinal supports are powered at different amplitudes. With an out-of-phase operation of the powered transverse supports, selective modes of oscillation are set which have an influence on the conveying behavior of the screened material on the machine.

The present invention is not limited to embodiments described herein; reference should be had to the appended claims.

LIST OF REFERENCE NUMERALS

1 Flip-flop screening machine
2 Side wall
3 Side wall
4*a* Transverse support (powered)
4*b* Transverse support (non-powered)
5 Outer tube casing
6 Electric (unbalance) motor
7 Motor shaft
8 Eccentric
9 Shaft bearing
10 Lateral rubber element
12 Lateral flange plate
F Direction of conveyance

What is claimed is:

1. A flip-flop screening machine comprising:
two screening machine side walls; and
transverse supports which are configured to carry screen panels, the transverse supports being provided as a powered transverse support and as a non-powered transverse support, the transverse supports being arranged between the two screening machine side walls in a transverse direction of a direction in which a screened material is conveyed,
wherein,
at least every second of the transverse supports is provided as the powered transverse support,
each powered transverse support is configured to perform at least one of oscillations and vibrations with movements in a transverse direction of a longitudinal axis of the powered transverse support so as to alternately compress and stretch the screen panels, and,
each powered transverse support comprises over a substantial part of a length or over an entire length thereof a separate oscillatory or vibratory drive which is arranged between the two screening machine side walls.

2. The flip-flop screening machine as recited in claim 1, further comprising:
resilient couplings,
wherein,
the powered transverse supports are connected with the two screening machine side walls via the resilient couplings so that at least one of additional circular/elliptic oscillations and linear oscillations are transferred to at least one of the screen panels and to the two screening machine side walls.

3. The flip-flop screening machine as recited in claim 1, wherein each powered transverse support comprises an outer tube casing which extends in the longitudinal direction of the powered transverse support, the outer tube casing comprising an interior space which is configured to accommodate the separate oscillatory or vibratory drive.

4. The flip-flop screening machine as recited in claim 3, wherein the separate oscillatory or vibratory drive is an electric unbalance motor.

5. The flip-flop screening machine as recited in claim 3, wherein the outer tube casing extends between the two screening machine side walls.

6. The flip-flop screening machine as recited in claim 1, wherein, the separate oscillatory or vibratory drive of each powered transverse support is arranged in an interior of the powered transverse support, and the separate oscillatory or vibratory drive is provided as an unbalance tubular motor or as a vibratory tubular motor.

7. The flip-flop screening machine as recited in claim 6, wherein, the unbalance tubular motor comprises a motor shaft which is parallel to the longitudinal axis of the powered transverse support, and an unbalance body is arranged on the motor shaft, the unbalance body extending over the substantial part of the length of the powered transverse support.

8. The flip-flop screening machine as recited in claim 7, wherein a geometry of the motor shaft is designed so that a mass of the unbalance body is integrated in the motor shaft so as to provide an unbalance/centrifugal force during the operation thereof.

9. The flip-flop screening machine as recited in claim 1, wherein, each powered transverse support comprises as the separate oscillatory or vibratory drive two electric motors, one of the two electric motors being arranged at each end of the powered transverse support, one motor shaft is arranged between the two electric motors, an unbalance body is arranged on the one motor shaft between the two motors, and each of the two electric motors is configured to generate at least one of oscillations and vibrations.

10. The flip-flop screening machine as recited in claim 9, wherein, an intermediate space exists between the two motors of the powered transverse support, and the unbalance body extends over the intermediate space.

11. The flip-flop screening machine as recited in claim 1, wherein, the flip-flop screening machine is divided into individual modules, and each of the individual modules comprises two screening machine side walls between which at least one powered transverse support and one non-powered transverse support extend.

12. The flip-flop screening machine as recited in claim 1, wherein the two screening machine side walls have a constant height over a length thereof.

13. The flip-flop screening machine as recited in claim 12, wherein the flip-flop screening machine has a modular design comprising modules which are coupled to each other so as to provide a double-deck flip-flop screening machine or a multiple-deck flip-flop screening machine.

14. The flip-flop screening machine as recited in claim 1, wherein, at least two of the powered transverse supports are provided, and the at least two powered transverse supports provide an out-of-phase operation so as to perform different movements.

15. The flip-flop screening machine as recited in claim 14, wherein the different movements are in opposite directions.

16. The flip-flop screening machine as recited in claim 14, wherein the at least two powered transverse supports are powered at different amplitudes.

17. The flip-flop screening machine as recited in claim 14, wherein, via the out-of-phase operation of the at least two powered transverse supports, selective modes of oscillation are set which influence a conveying behavior of the screened material on the flip-flop screening machine.

18. A flip-flop screening machine comprising:

longitudinal supports each of which comprises a front wall and a rear wall, the longitudinal supports being configured to carry screen panels, the longitudinal supports being provided as a powered longitudinal support and as a non-powered longitudinal support, the longitudinal supports being arranged in a transverse direction of a direction in which a screened material is conveyed, wherein, at least every second of the longitudinal supports is provided as the powered longitudinal support, each powered longitudinal support is configured to perform at least one of oscillations and vibrations with movements in a transverse direction of a longitudinal axis of the powered longitudinal support so as to alternately compress and stretch the screen panels, and, each powered longitudinal support comprises over a substantial part of a length or over an entire length thereof a separate oscillatory or vibratory drive which is arranged between the front wall and the rear wall.

19. The flip-flop screening machine as recited in claim 18, wherein, at least two of the powered longitudinal supports are provided, and the at least two longitudinal transverse supports provide an out-of-phase operation so as to perform different movements.

20. The flip-flop screening machine as recited in claim 19, wherein the different movements are in opposite directions.

21. The flip-flop screening machine as recited in claim 19, wherein the at least two powered longitudinal supports are powered at different amplitudes.

* * * * *